US006959881B2

(12) United States Patent
Kim

(10) Patent No.: US 6,959,881 B2
(45) Date of Patent: Nov. 1, 2005

(54) NOZZLE ASSEMBLY OF DISHWASHER

(75) Inventor: Yong Hee Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/721,738

(22) Filed: Nov. 26, 2003

(65) Prior Publication Data

US 2004/0195361 A1 Oct. 7, 2004

(30) Foreign Application Priority Data

Nov. 28, 2002 (KR) ..... P10-2002-0074990

(51) Int. Cl.[7] ..... B05B 3/06; B63H 11/10; B08B 3/00

(52) U.S. Cl. ..... 239/251; 239/265.19; 134/57 D; 134/176; 134/179

(58) Field of Search ..... 239/265.19, 251, 239/255, 256, 222.1, 258, 222.17; 134/56 D, 57 D, 58 D, 179, 176, 198, 201, 560, 570, 580

(56) References Cited

U.S. PATENT DOCUMENTS 3,496,949 A * 2/1970 Mercer ..... 134/179
4,266,565 A * 5/1981 Gurubatham ..... 134/144
5,331,986 A * 7/1994 Lim et al. ..... 134/88
5,427,129 A * 6/1995 Young et al. ..... 134/176
5,464,482 A * 11/1995 Michael et al. ..... 134/25.2
5,673,714 A * 10/1997 Campagnolo et al. .... 134/57 D
5,697,392 A * 12/1997 Johnson et al. ..... 134/176
5,964,232 A * 10/1999 Chung ..... 134/176
6,263,888 B1 * 7/2001 Nomura et al. ..... 134/57 D

* cited by examiner

*Primary Examiner*—David A. Scherbel
*Assistant Examiner*—Seth Barney
(74) *Attorney, Agent, or Firm*—Fleshner & Kim, LLP

(57) ABSTRACT

A nozzle of a dishwasher reduces a space for installing a supplementary nozzle on a main nozzle by having first and second connectors coupled to be caught on each other between main and auxiliary nozzles. The nozzle assembly includes a main nozzle having a first coupling hole; an auxiliary nozzle, having a second coupling hole, for coupling with the main nozzle; a first interlocking device, having a first end, for coupling with the main nozzle at the first coupling hole, by being caught in the first coupling hole by the first end; and a second interlocking device, having a first end, for coupling with the auxiliary nozzle at the second coupling hole, by being caught in the second coupling hole by the first end and by having a second end to be caught on the first interlocking device.

25 Claims, 6 Drawing Sheets

NOZZLE ASSEMBLY OF DISHWASHER

This application claims the benefit of Korean Application No. 10-2002-0074990 filed on Nov. 29, 2000, which is hereby incorporated by reference.

BACKGROUND OF THE INVENTION

1. Field of the Invention

The present invention relates to a nozzle assembly for use in a dishwasher, and more particularly, to such a nozzle assembly having an auxiliary nozzle mounted on a main nozzle using interlocking connectors to reduce a vertical installation space.

2. Discussion of the Related Art

Generally speaking, a dishwasher is provided with a water circulation means actuated by a wash pump. Thus, the washing of tableware and the like is performed by spraying washing water onto the tableware, which is placed on a sliding rack to be washed. The spaying action is achieved by a nozzle rotating under the force of the wash pump. To improve washing performance, a main nozzle may be provided with an auxiliary nozzle, which rotates on the main nozzle, as a nozzle assembly. Wash performance may be further improved by increasing the length of the auxiliary nozzle through an S-shaped configuration.

Referring to FIGS. 1 and 2, a dishwasher having a nozzle assembly according to a related art is comprised of a body 2 forming an exterior shape; a door 2*a* installed at a front side of the body; a washtub 4, installed in the body, where a sliding rack 6 for holding tableware and the like to be washed is installed; and a nozzle assembly 10, communicating with a water circulating means via an injection passage 8, for spraying water onto the tableware in the sliding rack. The nozzle assembly 10 is rotatably installed off-center with respect to the end of the injection passage 8, such that a main nozzle 12 has a short end and a long end, with an auxiliary nozzle 14 being rotatably coupled to the top of the short end of the main nozzle.

A plurality of injection holes 14*h* are provided on the top surface of the auxiliary nozzle 14 for spraying water toward the sliding rack 6, and a first cylindrical connector 16 having a flanged end 16*b* is disposed at the midpoint of its bottom surface. The first cylindrical connector 16 has a passage hole 16*h* of a predetermined diameter for allowing water to flow from the main nozzle 12.

A plurality of injection holes 12*h* are provided on a top surface of the long end of the main nozzle 12 for spraying water toward the sliding rack 6, and a second cylindrical connector 18 for receiving the first connector 16 of the auxiliary nozzle 14 is disposed at the short end. The second cylindrical connector 18 has a passage hole 18*h* of a predetermined diameter for allowing water to flow into the auxiliary nozzle 14.

The first and second cylindrical connectors 16 and 18 are screw-coupled to each other, thus coupling the auxiliary nozzle 14 to the main nozzle 12 and allowing water to flow from the main nozzle to the auxiliary nozzle via the passage holes 16*h* and 18*h*. To achieve the screw-coupling, the main nozzle 12 has a threaded coupling flange 12*a* having female threads and protruding upward to receive the male threads of a first connector coupler 16*a* provided at the bottom end of the first connector 16, and the auxiliary nozzle 14 has a threaded coupling flange 14*a* having female threads and protruding downward to receive the male threads of a second connector coupler 18*a* provided at the top end of the second connector 18. Thus, the second connector 18 is rotatably installed on the outer circumference of the first connector 16, so that the flanged end 16*b* of the first connector is caught on the second connector.

In the operation of a dishwasher having the nozzle assembly according to the related art, however, water is pumped from the water circulation means, which causes the main nozzle 12 to rotate on the injection passage 8 and the auxiliary nozzle 14 to rotate on the main nozzle. As the auxiliary nozzle 14 rotates on the main nozzle 12, one or both of the first and second connectors 16 and 18 may become decoupled from the auxiliary and main nozzles, respectively. To guard against such a decoupling, a minimum thread length versus diameter should be secured for each of the connector couplers 16*a* and 18*a*. This minimum length is a hindrance to minimizing a vertical installation space. Moreover, manipulation of the threaded components during assembly is cumbersome.

SUMMARY OF THE INVENTION

Accordingly, the present invention is directed to a nozzle assembly of a dishwasher that substantially obviates one or more of the problems due to limitations and disadvantages of the related art.

An object of the present invention, which has been devised to solve the foregoing problem, lies in providing a nozzle assembly of a dishwasher, which reduces a vertical installation space required for installing an auxiliary nozzle on a main nozzle.

It is another object of the present invention to provide a nozzle assembly that improves productivity during an assembly stage of a dishwasher adopting the nozzle assembly.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a nozzle assembly of a dishwasher, comprising a main nozzle having a first coupling hole; an auxiliary nozzle, having a second coupling hole, for coupling with the main nozzle; first interlocking means, having a first end, for coupling with the main nozzle at the first coupling hole, by being caught in the first coupling hole by the first end; and second interlocking means, having a first end, for coupling with the auxiliary nozzle at the second coupling hole, by being caught in the second coupling hole by the first end and by having a second end to be caught on the first interlocking means.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
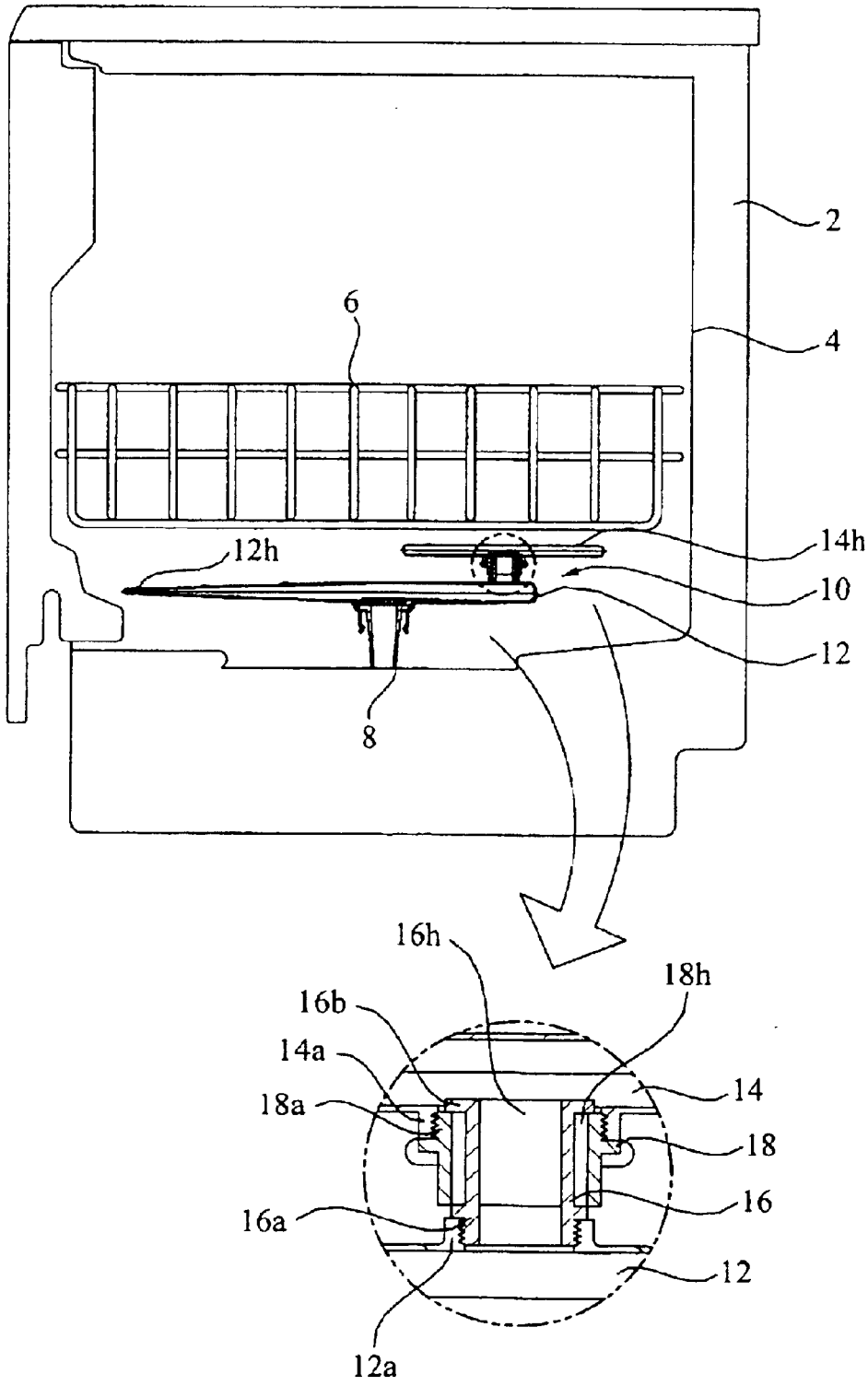
FIG. 1 Related Art
FIG. 1 is a cross-sectional view of a dishwasher having a nozzle assembly according to a related art.
Figure 2:
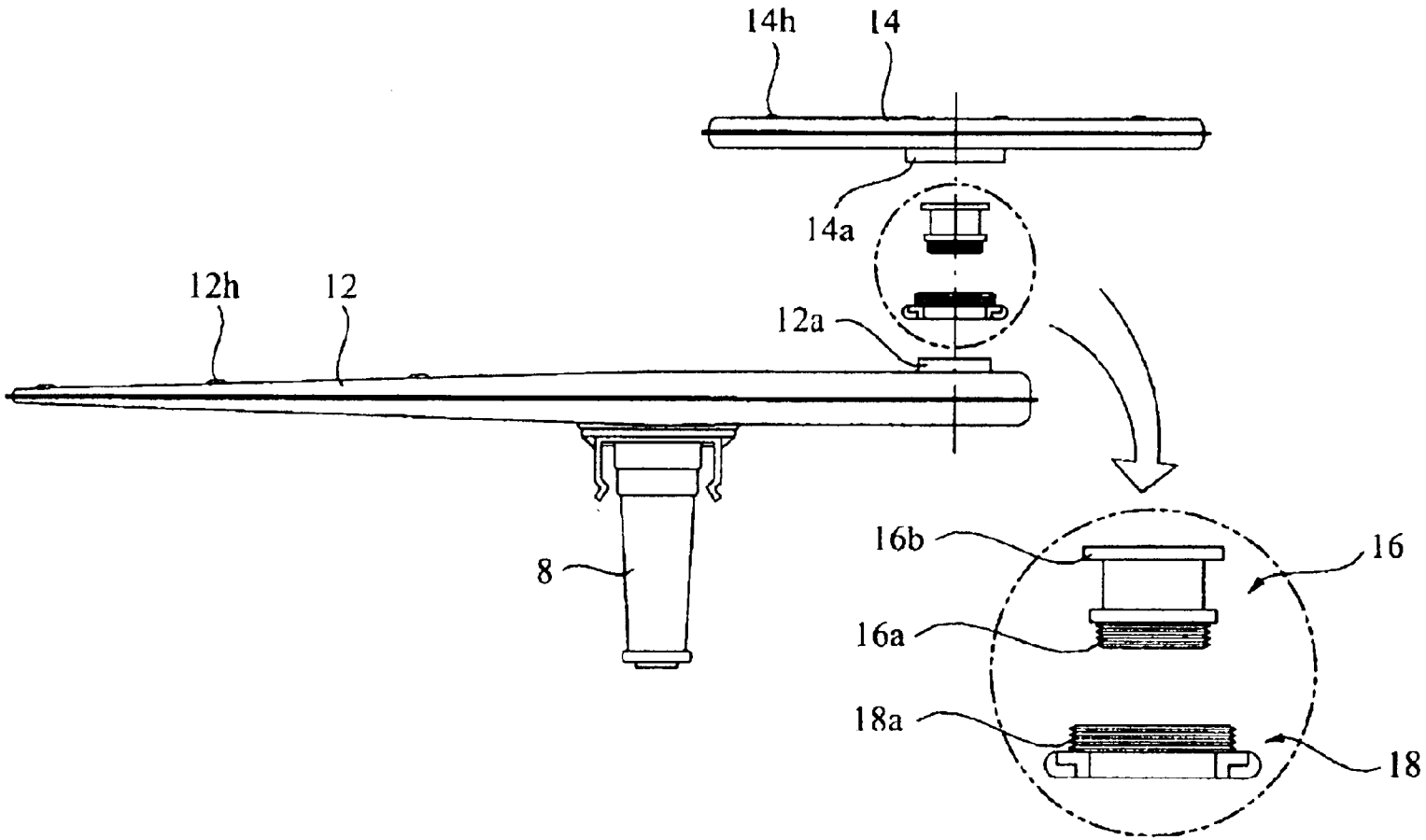
FIG. 2 Related Art
FIG. 2 is a breakaway side view of the nozzle assembly shown in FIG. 1.
Figure 3:
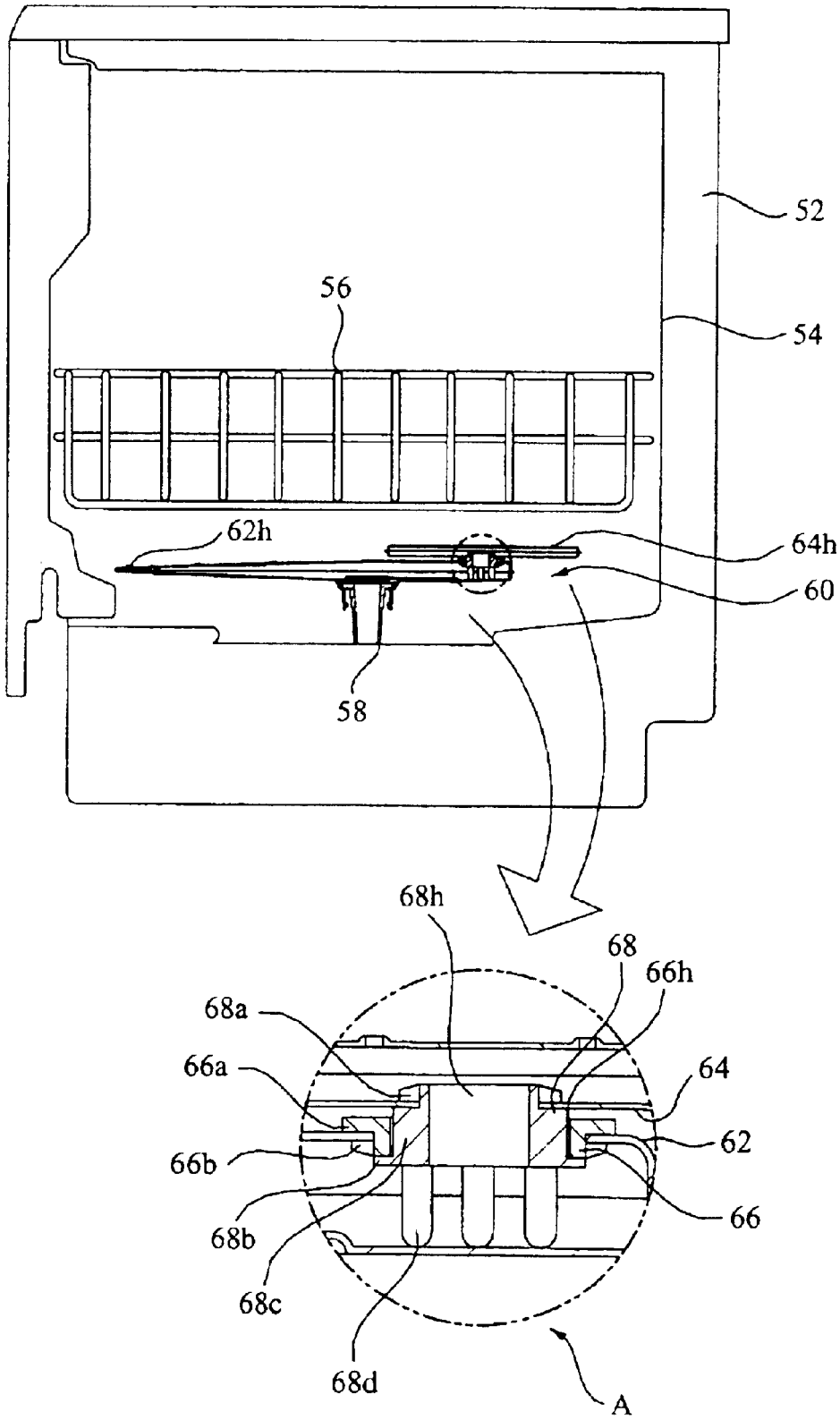
FIG. 3 is a cross-sectional view of a dishwasher having a nozzle assembly according to the present invention.
Figure 4:
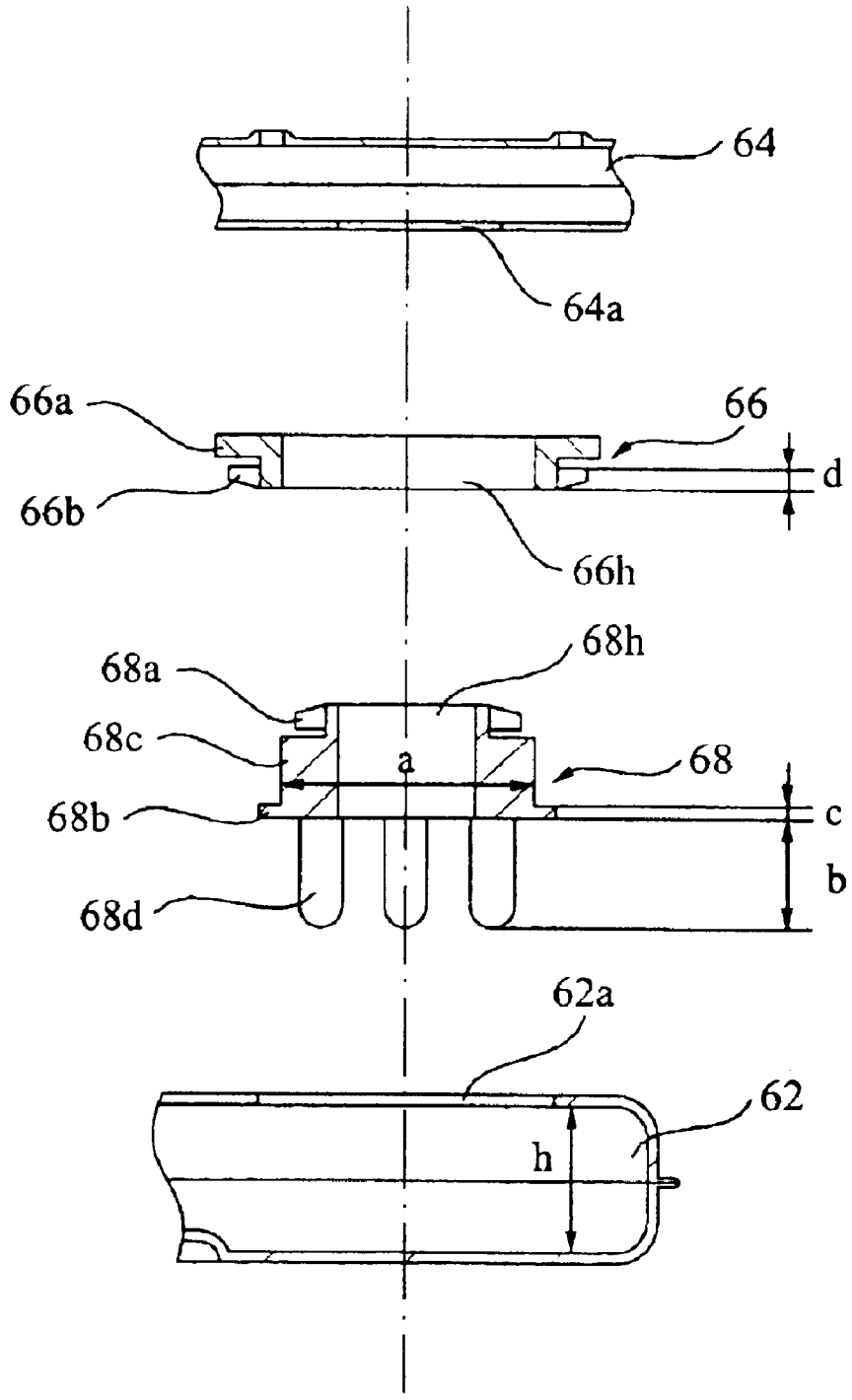
FIG. 4 is a breakaway view of the cross-section A of FIG. 3.
Figure 5:
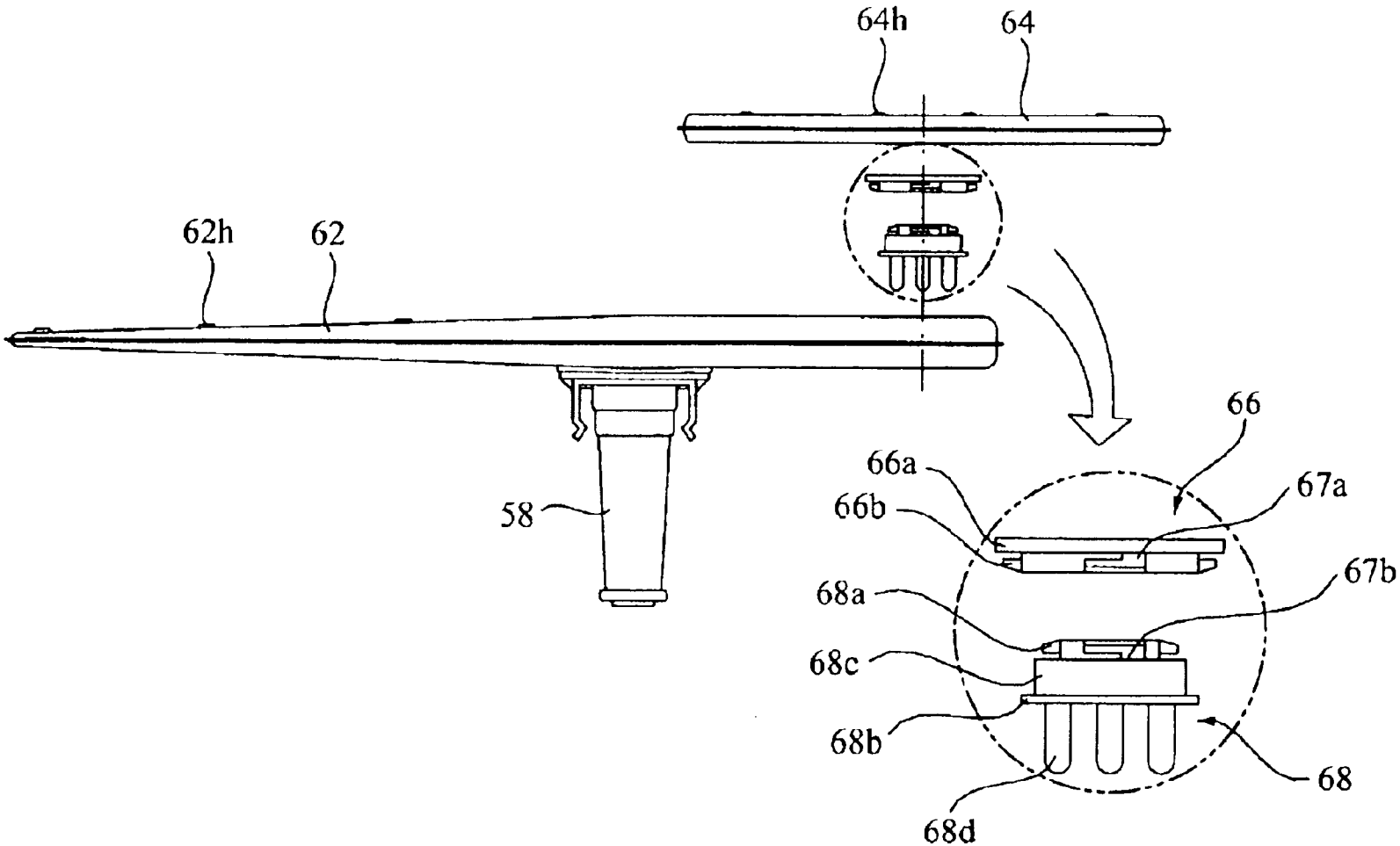
FIG. 5 is a breakaway side view of a nozzle assembly according to the present invention.
Figure 6:
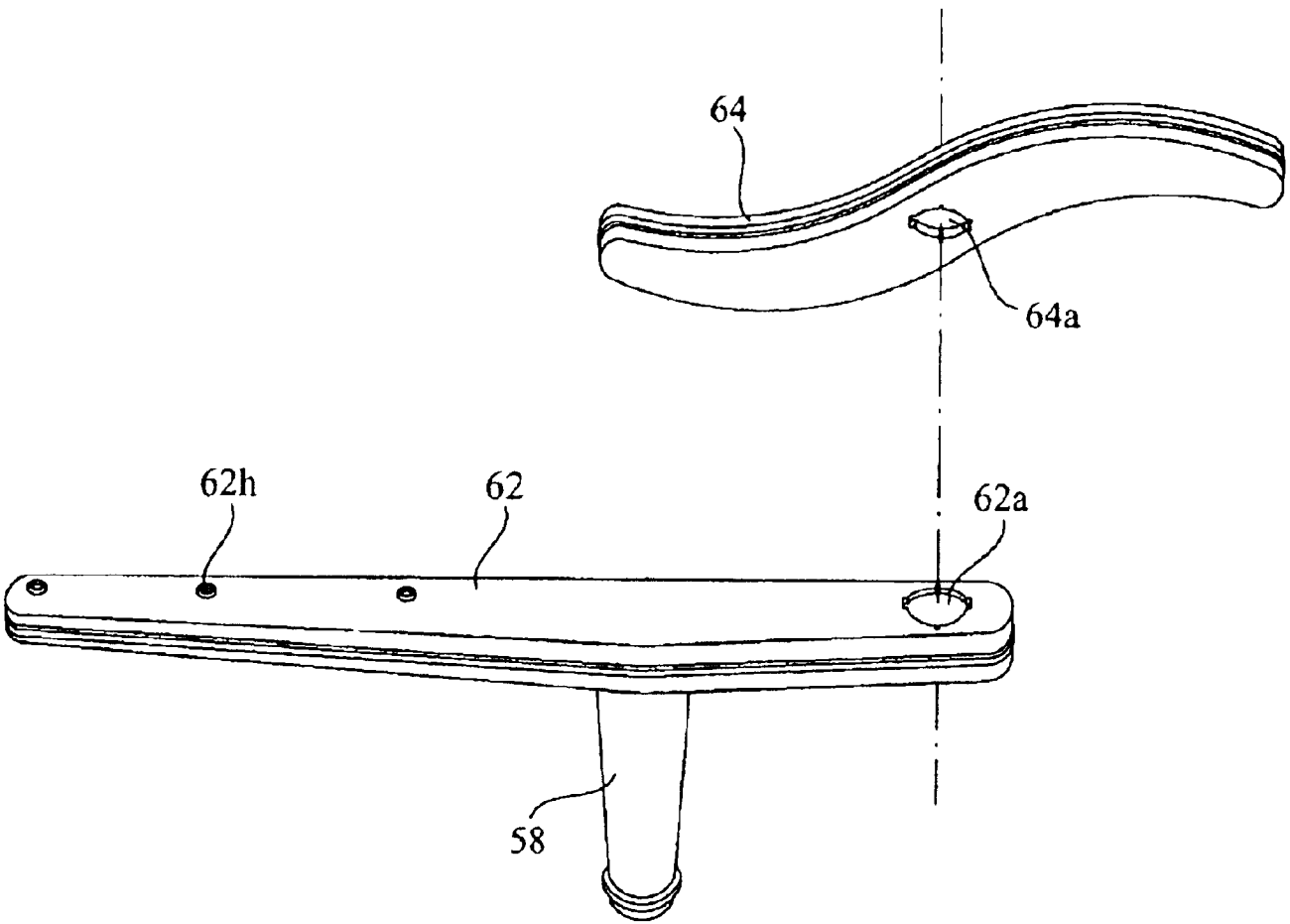
FIG. 6 is a breakaway perspective view of the nozzles of the nozzle assembly according to the present invention.

Referring to FIGS. 3–6 a dishwasher having a nozzle assembly according to a related art is comprised of a body 52 forming an exterior shape; a washtub 4, installed in the body, where a sliding rack 56 for holding tableware and the like to be washed is installed; and a nozzle assembly 60, communicating with a water circulating means via an injection passage 58, for spraying water onto the tableware in the sliding rack. The nozzle assembly 60 is rotatably installed off-center with respect to the end of the injection passage 58, such that a main nozzle 62 has a short end and a long end, with an auxiliary nozzle 64 being rotatably coupled to the top of the short end of the main nozzle.

A plurality of injection holes 64*h* are provided on the top surface of the auxiliary nozzle 64 for spraying water toward the sliding rack 56 and a first interlocking connector 66 is disposed at the midpoint of its bottom surface. The first interlocking connector 66 has a passage hole 66*h* of a predetermined diameter for allowing water to flow from the main nozzle 62 and for facilitating its coupling with the auxiliary nozzle 64.

A plurality of injection holes 62*h* are provided on a top surface of the long end of the main nozzle 62 for spraying water toward the sliding rack 56, and a second interlocking connector 68 for receiving the first connector 66 of the auxiliary nozzle 64 is disposed at the short end. The second interlocking connector 68 has a passage hole 68*h* of a predetermined diameter for allowing water to flow into the auxiliary nozzle 64 and for facilitating its coupling with the main nozzle 62.

Accordingly, the first and second interlocking connectors 66 and 68 are coupled to each other, thus coupling the auxiliary nozzle 64 to the main nozzle 62 and allowing water to flow from the main nozzle to the auxiliary nozzle via the passage holes 66*h* and 68*h*. To achieve the coupling, the first connector 66 is interlocked with the coupling hole 62*a* of the main nozzle 62, and the second connector 68 is interlocked with the coupling hole 64*a* of the auxiliary nozzle 64 while being caught on the first connector. The lips of the coupling holes 62*a* and 64*a* are each notched to receive and catch a plurality of protrusions (described later) formed on the first and second connectors 66 and 68, respectively, which are inserted in the coupling holes and rotated during assembly.

The above interlocking action is achieved by a first interlocking means of the first connector 66 acting on the coupling hole 62*a* of the main nozzle 62 and a second interlocking means of the second connector 68 acting on the coupling hole 64*a* of the auxiliary nozzle 64 and on the first connector. That is, the first connector 66 comprises a first flange 66*a* on the outer circumference of its upper end, to abut on the lip of the coupling hole 62*a* of the main nozzle 62; and a plurality of first protrusions 66*b* on the outer circumference of its lower end, to be caught on the lip of the main nozzle's coupling hole when, during assembly, the first connector is rotated by a predetermined angle until stopped by at least one slotted stop 67*b* formed in the second connector. Meanwhile, the second connector 68 comprises a plurality of second protrusions 68*a* on the outer circumference of its upper end, to be caught on the lip of the coupling hole 64*a* of the auxiliary nozzle 64 when, during assembly, the second connector is rotated by a predetermined angle until stopped by at least one slotted stop 67*a* formed in the first connector; a second flange 68*b* on an outer circumference of its lower end, to be caught on the lower end of the first connector 66; and a load-bearing shaft 68*c* extending between the second protrusions and the second flange, to be inserted in the passage hole 66*h* of the first connector. Thus, the diameter of the passage hole 66*h* of the first connector 66 is greater than a diameter "a" of the load-bearing shaft 68*c* of the second connector 68, so that the first connector can be rotatably installed on the second connector.

The second connector 68 further comprises a plurality of supports 68*d* to provide a counteracting support, with respect to the opposite inner wall of the main nozzle 62, allowing the second flange 68*b* of the second connecter 68 to be caught on the lower end of the first connector 66 while the first protrusions 66*b* of the first connector are interlocked with the coupling hole 62*a* of the main nozzle 62. Each support 68*d* has a height "b" determined by the equation d+c+b=h, where "d" is the thickness of the first protrusions 66*b*, "c" is the thickness of the second flange 68*b*, and "h" is the inner height of the main nozzle 62.

Though not specifically shown in the drawings, the formation of the first and second slotted stops 67*a* and 67*b* may overlap the first and second protrusions 66*b* and 68*a*, respectively.

In assembling the nozzle assembly according to the present invention, the load-bearing shaft 68*c* of the second connector 68 is fitted into the first connector 66 so that the lower end of the first connector is seated against the second flange 68*b*. Then, with the first protrusions 66*b* fitted into the coupling hole 62*a* of the main nozzle 62, so that the supports 68 are pressed against the opposite inner surface of the main nozzle 62 and the first flange 66*a* is seated against the lip of the coupling hole 62*a*, the first and second connectors 66 and 68 are rotated together by a predetermined angle, for example, an angle of less than ±90°. The rotation is stopped at a predetermined angle, greater than the above angle of rotation, by the slotted stop 67*a* of the first connector.

Subsequently, the second protrusions 68*b* are fitted into the coupling hole 64*a* of the auxiliary nozzle 64, and the second connector 68 is rotated by a predetermined angle, for example, an angle of less than ±90°. The rotation is stopped at a predetermined angle, greater than the above angle of rotation, by the slotted stop 67*b* of the second connector.

By adopting the nozzle assembly of a dishwasher according to the present invention, wherein an auxiliary nozzle is mounted on one end of a main nozzle, a vertical installation space required for installing the auxiliary nozzle on the main nozzle by respectively coupling the first and second interlocking connectors to the nozzles, to be rotatably interlocked at one end of each connector, and providing protrusions at the other ends thereof to be coupled with and caught on coupling holes provided in each nozzle. Moreover, since the first and second protrusions are installed to be caught in the coupling holes by a simple rotation (twisting action) of the connectors, assembly is simplified and productivity is improved accordingly.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A nozzle assembly of a dishwasher, comprising:

a main nozzle having a coupling hole defined by a lip of a first wall of the main nozzle;

an auxiliary nozzle having a coupling hole defined by a lip of a first wall of the auxiliary nozzle, for coupling with said main nozzle;

first interlocking means having a first end and a second end for coupling with said coupling hole of said main nozzle by being lockingly coupled to the lip of the coupling hole of said main nozzle by the first end of the first interlocking means; and second interlocking means having a first end and a second end for coupling with said coupling hole of said auxiliary nozzle by being lockingly coupled to the lip of the coupling hole of the auxiliary nozzle by the first end of the second interlocking means, and by having the second end of the second interlocking means engaged with the first end of said first interlocking means, wherein the second interlocking means is configured to be disposed in both the auxiliary nozzle and the main nozzle in an assembled configuration of the nozzle assembly.

2. The nozzle assembly as claimed in claim 1, wherein said first and second interlocking means are each provided with a passage allowing water flow between said main and auxiliary nozzles.

3. The nozzle assembly as claimed in claim 1, wherein said first and second interlocking means are rotatably assembled with respect to each other.

4. The nozzle assembly as claimed in claim 3, wherein said first interlocking means rotates on said second interlocking means.

5. The nozzle assembly as claimed in claim 1, said first interlocking means comprising:

a flange formed on the second end of the first interlocking means to abut an exterior surface of the first wall of said main nozzle; and a plurality of protrusions formed on the first end of the first interlocking means, to be fittingly received in the lip of the coupling hole of the main nozzle when said first interlocking means is rotated by a first predetermined angle.

6. The nozzle assembly as claimed in claim 5, said first interlocking means further comprising at least one slotted stop formed between said flange and said plurality of protrusions, so that said protrusions are prevented from rotating beyond a second predetermined angle when fitted into the lip of the coupling hole of the main nozzle.

7. The nozzle assembly as claimed in claim 1, said second interlocking means comprising:

a plurality of protrusions formed on the first end of the second interlocking means to be fittingly received in the lip of the coupling hole of the auxiliary nozzle when said second interlocking means is rotated by a first predetermined angle;

a flange formed on the second end of the second interlocking means to seat against said first interlocking means; and a load-bearing shaft formed between said flange and said protrusions, for rotatably inserting in said first interlocking means.

8. The nozzle assembly as claimed in claim 7, said second interlocking means further comprising a plurality of supports formed at the second end of the second interlocking means for providing support with respect to an opposing inner surface of a second wall of said main nozzle, to allow said flange to seat against the first end of said first interlocking means.

9. The nozzle assembly as claimed in claim 7, said second interlocking means further comprising at least one slotted stop formed between said load-bearing shaft and said protrusions, so that said protrusions are prevented from rotating beyond a second predetermined angle when fitted into the lip of coupling hole of the auxiliary nozzle.

10. The nozzle assembly as claim 7, said load bearing shaft configured to be rotatably disposed in the first interlocking means.

11. The nozzle assembly as claimed in claim 8, said plurality of supports configured to contact the opposing inner surface of the second wall of said am nozzle.

12. The nozzle assembly as claimed in claim 5, further comprising a plurality of notches formed in the lip of the coupling hole of said main nozzle to respectively receive said protrusions.

13. The nozzle assembly as claimed in claim 7, further comprising a plurality of notches formed in the lip of the coupling hole of said auxiliary nozzle to respectively receive said protrusions.

14. The nozzle assembly as claimed in claim 1, wherein a maximum outer diameter of the second interlocking means is defined by an outer diameter o the second end of the second interlocking device, and wherein the outer diameter of the second end of the second interlocking device is greater than a diameter of the coupling hole of the auxiliary nozzle, and less than a diameter of the coupling hole of the main nozzle.

15. A dishwasher having the nozzle assembly of claim 1.

16. An apparatus for rotatably coupling first and second spray nozzles for use in a dishwasher, comprising:

a first interlocking device having first and second opposing ends, at least one protruding portion having a thickness, d, formed at the first end, a flange formed at the second end, and a through-hole extending from the first end to the second end; and a second interlocking device having first and second opposing ends, a shaft formed between the first and second ends, at least one protruding portion formed at the first end, a flange having a thickness, c, formed at the second end, a through-hole extending from the first end to the second end, and support members extending a distance, b, from the second end, wherein the at least one protruding portion of the first interlocking device, the flange of the second interlocking device, and the support members are configured to be disposed in the first spray nozzle by a coupling hole in the first spray nozzle.

17. The apparatus of claim 16, wherein the first spray nozzle has first and second walls that define an inner height, h, and wherein h=d+c+b.

18. The apparatus of claim 16, wherein the at least one protruding portion of the second interlocking device is configured to be disposed in the second spray nozzle by a coupling hole in the second spray nozzle.

19. A coupling apparatus for coupling an auxiliary nozzle to a main nozzle, comprising:

a first connector having an inner diameter and an outer diameter, comprising:

a flange configured to abut an exterior surface of a coupling hole wall of the main nozzle;

a protrusion configured to abut an interior surface of the coupling hole wall; and a seating surface adjacent the protrusion; and a second connector comprising:

a protrusion configured to abut an interior surface of a coupling hole wall of the auxiliary nozzle;

a shaft having an outer diameter that is less than the inner diameter of the first connecter, and configured to be rotatably disposed in the first connector; and a flange for seating against the seating surface of the first connector.

20. The apparatus of claim 19, wherein the second connector further comprises a plurality of supports for contacting an interior surface of a wall of the main nozzle opposing the coupling hole wall of the main nozzle.

21. The apparatus of claim 19, wherein the protrusion of the first connector is configured to be inserted into a slot formed in the coupling hole wall of the main nozzle, and wherein the first connector and the protrusion are also configured to be rotated with respect to the main nozzle to affix the first connector to the main nozzle.

22. The apparatus of claim 21, wherein the first connector further comprises a slotted stop that is configured to limit rotation of the first connector relative t the main nozzle.

23. The apparatus of claim 21, wherein the protrusion of the second connector is configured to be inserted into a slot formed in the coupling hole wall of th auxiliary nozzle, and wherein the second connector and the protrusion are also configured be rotated with respect to the auxiliary nozzle to affix the second connector to the main nozzle.

24. The apparatus of claim 19, wherein the protrusion of the second connector is configured to be inserted into a slot formed in the coupling hole wall of the auxiliary nozzle, and wherein the second connector and the protrusion are also configured to be rotated with respect to the auxiliary nozzle to affix the second connector to the main nozzle.

25. The apparatus of claim 24, wherein the second connector further comprises a slotted stop that is configured to limit rotation of the second connector relative to the auxiliary nozzle.

* * * * *